US010711798B2

(12) United States Patent
Halcoussis

(10) Patent No.: US 10,711,798 B2
(45) Date of Patent: Jul. 14, 2020

(54) VARIABLE TURBOMACHINE VANE CASCADE

(71) Applicant: MTU Aero Engines AG, Munich (DE)

(72) Inventor: Alexander Halcoussis, Haimhausen (DE)

(73) Assignee: MTU Aero Engines AG, Munich (DE)

( * ) Notice: Subject to any disclaimer, the term of this patent is extended or adjusted under 35 U.S.C. 154(b) by 363 days.

(21) Appl. No.: 15/646,214

(22) Filed: Jul. 11, 2017

(65) Prior Publication Data

US 2018/0017081 A1 Jan. 18, 2018

(30) Foreign Application Priority Data

Jul. 13, 2016 (DE) ..... 10 2016 212 767

(51) Int. Cl.
*F04D 29/56* (2006.01)
*F01D 9/04* (2006.01)
*F01D 17/16* (2006.01)

(52) U.S. Cl.
CPC ..... *F04D 29/563* (2013.01); *F01D 9/041* (2013.01); *F01D 17/162* (2013.01); *F05D 2220/32* (2013.01); *F05D 2240/129* (2013.01); *F05D 2260/961* (2013.01); *F05D 2270/101* (2013.01)

(58) Field of Classification Search
CPC ..... F04D 29/563; F01D 17/162; F01D 9/041; F05D 2240/129; F05D 2220/32; F05D 2270/101; F05D 2260/961
See application file for complete search history.

(56) References Cited

U.S. PATENT DOCUMENTS 3,861,822 A * 1/1975 Wanger ..... F01D 17/162 415/147
4,049,360 A 9/1977 Snell
(Continued)

FOREIGN PATENT DOCUMENTS

CH 360074 2/1962
DE 2618727 11/1976
(Continued)

OTHER PUBLICATIONS

Zhang et al:"Impact of stagger angle non uniformity on turbine aerodynamic performance," *Journal of Thermal Science*, vol. 19, Issue 5, Oct. 2010.

(Continued)

*Primary Examiner* — Hung Q Nguyen
(74) *Attorney, Agent, or Firm* — Davidson, Davidson & Kappel, LLC

(57) ABSTRACT

A variable vane cascade for a turbomachine, in particular for a compressor stage or turbine stage of a gas turbine, having at least one first vane, in particular guide vane that has a first distance from a circumferentially adjacent vane, at least one second vane, in particular guide vane that has at least one second distance from at least one circumferentially adjacent vane that is smaller than the first distance, and an actuating device, in particular for jointly and/or reversibly adjusting the first and second vane from a first position where at least one airfoil cross section of the first vane and an airfoil cross section of the second vane each have a first stagger angle, into a second position where these airfoil cross sections have second stagger angles, the second stagger angle of the first vane differing from the second stagger angle of the second vane, in particular being larger than the second stagger angle of the second vane.

25 Claims, 2 Drawing Sheets

(56) References Cited

U.S. PATENT DOCUMENTS

| | | | |
|---|---|---|---|
| 8,672,618 | B2 | 3/2014 | Guemmer |
| 2010/0180572 | A1 | 7/2010 | Wadia et al. |
| 2013/0280054 | A1 | 10/2013 | Holmes |
| 2015/0159551 | A1 | 6/2015 | Lahmer et al. |

FOREIGN PATENT DOCUMENTS

| | | |
|---|---|---|
| DE | 19741992 | 3/1999 |
| DE | 10351202 | 6/2005 |
| DE | 102008058014 | 5/2010 |
| GB | 878988 | 10/1961 |
| JP | 2004100553 | 4/2004 |
| RU | 2145391 C1 | 2/2000 |

OTHER PUBLICATIONS

Miyakozawa:"Flutter and Forced Response of Turbomachinery With Frequency Mistuning and Aerodynamic Asymmetry," Dissertation submitted in partial fulfillment of the requirements for the degree of Doctor of Philosophy in the Department of Mechanical Engineering and Materials Science in the Graduate School of Duke University, Apr. 2008, 172 pages.

Mayorca:"Development and Validation of a Numerical Tool for the Aeromechanical Design of Turbomachinery," Department of Energy Technology School of Industrial Technology and Management Royal Institute of Technology Stockholm, Sweden, Feb. 2010, 54 pages.

* cited by examiner

VARIABLE TURBOMACHINE VANE CASCADE

This claims the benefit of German Patent Application DE102016212767.5, filed Jul. 13, 2016 and hereby incorporated by reference herein The present invention relates to a variable vane cascade for a turbomachine, in particular a compressor stage or turbine stage of a gas turbine, a turbomachine, in particular a gas turbine, having the variable vane cascade, as well as to a method for adjusting the vane cascade.

BACKGROUND

The German Patent Application DE 103 51 202 A1 describes a device for adjusting guide vanes of a gas turbine, where guide vanes are pivotably coupled by actuating levers to an actuating ring, all guide vanes of the same guide vane ring being uniformly pivotable by the actuating ring.

The U.S. Patent Application 2015/0159551 A1 discusses a guide vane ring having variable guide vanes; in the circumferential direction, two guide vanes having a different spacing than the other guide vanes ("cyclic spacing").

SUMMARY OF THE INVENTION

It is an object of the present invention to improve a turbomachine, in particular a gas turbine, and/or the operation thereof.

The present invention provides a turbomachine, in particular a gas turbine, having at least one vane cascade described here, respectively and a method for adjusting a vane cascade described here. Advantageous embodiments of the present invention are also disclosed.

In an embodiment of the present invention, a variable vane cascade for a turbomachine, in particular for a compressor stage or a turbine stage of a gas turbine, in particular, at least one variable vane cascade of a turbomachine, in particular, of at least one compressor stage and/or at least one turbine stage of a gas turbine; without limiting generality, at least one vane is referred to as a first vane, in particular as a stator vane or casing-side vane and/or guide vane, which is spaced in the circumferential direction from one or both circumferentially adjacent, in particular further vane(s), in particular (further) stator vane(s) or casing-side vane(s) and/or guide vane(s), by a first distance which, without limiting generality, is referred to as the first distance, and at least one vane, without limiting generality, is referred to here as the second vane, in particular a stator vane or casing-side vane and/or guide vane, which, circumferentially, has a distance, without limiting generality, is referred to here as the second distance of one or both circumferentially adjacent, in particular other vane(s), in particular (other) stator vane(s) or casing-side vane(s) and/or guide vane(s). The present invention may be applied very advantageously to guide vane cascades, in particular of compressor stages, in particular high-pressure compressor stages of gas turbines, without being limited thereto.

In an embodiment of the present invention, the second distance is smaller than the first distance, in particular by at least 1%, in particular at least 5%, and/or by no more than 75%, in particular no more than 50% than the first or second distance.

More specifically, this makes it possible in an embodiment to reduce unwanted resonances between adjacent vanes.

In an embodiment of the present invention, the vane cascade has an actuating device which allows the first vane to be adjusted, in particular pivoted or rotated, or which adjusts, in particular pivots or rotates the first vane, in particular reversibly, from a position, in particular angular position, without limiting generality, referred to here as a first position (of the first vane, respectively of the vane cascade), where at least one airfoil cross section of the first vane has a stagger angle, without limiting generality, referred to here as the first stagger angle (of the first vane), into a position, in particular angular position, without limiting generality, referred to here as a second position (of the first vane or of the vane cascade), where (at least) this airfoil cross section (of the first vane) has a stagger angle, without limiting generality, referred to here as the second stagger angle (of the first vane); and, in particular jointly with the first vane and/or reversibly and/or equidirectionally, the second vane, from a position, in particular angular position, without limiting generality, referred to here as a first position (of the second vane, respectively of the vane cascade), where at least one airfoil cross section of the second vane has a stagger angle, without limiting generality, referred to here as the first stagger angle (of the second vane), may be adjusted into a position, in particular angular position, without limiting generality, referred to here as a second position (of the second vane, respectively of the vane cascade), where (at least) this airfoil cross section (of the second vane) has a stagger angle, without limiting generality, referred to here as the second stagger angle (of the second vane), respectively, is adapted or used for this purpose.

In an embodiment of the present invention, the second stagger angle of the first vane differs from the, in particular equidirectional second stagger angle of the second vane that, in particular, is larger than the second stagger angle of the second vane, in particular, by at least 1°, in particular at least 5°, and/or by at least 1%, in particular at least 5% than the first or second stagger angle of the first or second vane, and/or not more than 45°, in particular not more than 25°, and/or not more than 50%, in particular not more than 25% than the first or second stagger angle of the first or second vane.

In one variant, advantageous flow conditions may hereby be produced in each case at different positions of the vane cascade, respectively of the first and second vane, and thus, in an embodiment, a performance and/or suction limit improved or, conversely, a deterioration of the flow conditions reduced by adjusting the vane cascade. Notably, in a variant, in the case of smaller or more open stagger angles, advantageous outgoing flows, in particular outflow angles, and/or in the case of larger or more closed stagger angles, advantageous conditions, in particular, free flow cross sections may be produced between adjacent vanes.

In the present case, the angle is denoted in a variant as a stagger angle or also as a vane angle as is customary in the art, that forms the pressure-side tangent line at the particular airfoil cross section or the (pressure-side) airfoil tangent or chord line with the axial direction. As is customary in the art, in an embodiment, stagger angle $\beta$ is equal to half of the sum of angle of attack and outflow angle $\alpha_1$, $\alpha_2$ of airfoil cross section ($\beta=(\alpha_1+\alpha_2)/2$). In an embodiment, the (relevant, respectively at least one) airfoil cross section of the first and second vane, respectively of the particular airfoil thereof is an airfoil cross section at the same radial height, in particular an airfoil cross section at the airfoil root, at the airfoil tip or at half of the radial airfoil height. Accordingly, in an embodiment, in the first position of the first and second vane, respectively of the vane cascade; at least one airfoil cross section of the first vane has the first stagger angle of the first vane, and, at the same radial height, an airfoil cross section of the second vane has the first stagger angle of the second vane; and, in the second position of the first and second vane, respectively of the vane cascade of this airfoil cross section of the first vane, has the second stagger angle of the first vane; and this airfoil cross section of the second vane has the second stagger angle of the second vane.

Notably, as is customary in the art, the axial direction is referred to here as a direction that is parallel to a rotation or (main) machine axis of the turbomachine or gas turbine (stage), in particular, extending from a turbomachine or vane cascade inlet or entry to a turbomachine or vane cascade outlet or exit; accordingly, the direction referred to as radial direction is a direction that is orthogonal to and extends away from the rotation or (main) machine axis; accordingly, the circumferential direction is referred to as a direction of rotation about this axis, respectively of a rotor of the turbomachine or gas turbine (stage), in particular of the adjustable rotor blade cascade or of a rotor blade cascade that is axially adjacent to the adjustable rotor blade cascade.

An angle between the adjusting axes, in particular the pivot axes, respectively rotational axes, of the two adjacent vanes, respectively a corresponding circumferential length, respectively segmental length is referred to as the distance, respectively pitch between two circumferentially adjacent vanes, in the present case in the circumferential direction, notably as is customary in the art, in particular a circumferential length, respectively segmental length between pivot bearings of two vanes.

In an embodiment, the first stagger angle of the first vane is equal to the, in particular equidirectional first stagger angle of the second vane. In other words, in an embodiment, there is at least one, respectively the first position of the first and second vane, respectively of the vane cascade, where the first and second vane, respectively the vane cascades thereof have the same stagger angle at least at one radial height.

Similarly, in an embodiment, the first stagger angle of the first vane may differ from the, in particular equidirectional first stagger angle of the second vane that, in particular is larger or preferably smaller than the first stagger angle of the second vane, in particular by at least 1°, in particular at least 5°, and/or by at least 1%, in particular at least 5% than the first or second stagger angle of the first or second vane and/or by no more than 45°, in particular no more than 25°, and/or by no more than 50%, in particular no more than 25% than the first or second stagger angle of the first or second vane.

In particular, in a preferred embodiment, the first vane, respectively the at least one airfoil cross section thereof, may have a larger stagger angle in at least one (second) position, and, in at least one (first) position, a smaller stagger angle than the second vane, respectively the at least one airfoil cross section thereof. In another embodiment, the stagger angle of the first vane, respectively of the at least one airfoil cross section thereof, is always larger or smaller over the entire adjustment range than the second stagger angle of the second vane, respectively of the at least one airfoil cross section.

In one variant, advantageous flow conditions may hereby be produced in each case at different positions of the vane cascade, respectively of the first and second vane; and thus, in an embodiment, a performance and/or suction limit improved or, conversely, a deterioration of the flow conditions reduced by adjusting the vane cascade.

In an embodiment, the first and/or second position of the first and/or second vane limits the (respective) adjustment range thereof on one or both sides. Similarly, in an embodiment, the first vane may be adjusted or is adjusted from the first position beyond the second position, and/or from the second position beyond the first position; and/or the second vane may be adjusted or is adjusted from the first position beyond the second position, and/or from the second position beyond the first position, respectively be adapted for this purpose.

In one variant, advantageous flow conditions may be hereby produced in each case at different positions of the vane cascade, respectively of the first and second vane; and thus, in an embodiment, a performance and/or suction limit improved or, conversely, a deterioration of the flow conditions reduced by adjusting the vane cascade.

In an embodiment, the first stagger angle of the first vane is larger or preferably smaller than the second stagger angle of the first vane, in particular by at least 1°, in particular at least 5°, and/or by no more than 1%, in particular at least 5% than the first or second stagger angle of the first vane, and/or by no more than 75°, in particular no more than 45°, and/or no more than 50%, in particular no more than 25% than the first or second stagger angle of the first vane. Additionally or alternatively, in an embodiment, the first stagger angle of the second vane may be larger or, preferably, smaller than the second stagger angle of the second vane, in particular by at least 1°, in particular at least 5°, and/or by at least 1%, in particular at least 5% than the first or second stagger angle of the second vane, and/or by no more than 75°, in particular no more than 45°, and/or by no more than 50%, in particular no more than 25% than the first or second stagger angle of the second vane.

In one variant, advantageous flow conditions may hereby be produced in each case at different positions of the vane cascade, respectively of the first and second vane; and thus, in an embodiment, a performance and/or suction limit improved or, conversely, a deterioration of the flow conditions reduced by adjusting the vane cascade.

In an embodiment, the actuating device has a single- or multi-part actuating means, in particular an actuating ring for jointly and/or reversibly, in particular equidirectionally adjusting the first and second vane from the first into the second position, that couples the first vane by at least one first coupling element, without limiting generality, referred to here as the first coupling element, in particular by a (first) actuating lever; and the second vane by at least one coupling element, without limiting generality, referred to here as the second coupling element, in particular a (second) actuating lever. In this regard, reference is also made to the German Patent Application DE 103 51 202 A1 mentioned at the outset and the contents thereof which are explicitly incorporated by reference herein.

In an embodiment, such an, in particular joint actuating means makes it possible for the first and second vane to be advantageously adjusted and for the vane cascade to thus be adapted to different boundary, in particular operating, and/or flow conditions; at the same time, in an embodiment, the airfoil cross sections being advantageously suitably adjusted and, thus, the (first, respectively second) stagger angles thereof set.

In an embodiment, the actuating means is rotationally and/or, in particular simultaneously adjusted or adjustable, in particular translationally in a positively coupled manner, respectively adapted for this purpose; in particular is pivotable in the axial direction or about the rotation axis, respectively (main) machine axis of the turbomachine, and/or is displaceable in this direction, respectively parallel thereto. Additionally or alternatively, in an embodiment, the actuating means is connected to the first coupling element by a joint, without limiting generality, referred to here as a first joint, in particular, and/or to the second coupling element by a joint, without limiting generality, referred to here as the second joint. In an embodiment, the first coupling element is connected to a pivot axis of the first vane for corotation therewith, and/or the second coupling element is connected to a pivot axis of the second vane for corotation therewith. In this regard, reference is also made, in particular to the German Patent Application DE 103 51 202 A1 mentioned at the outset.

In an embodiment, the first and second vane may be advantageously adjusted, and the vane cascade be thus adapted to different boundary, in particular operating, and/or flow conditions; at the same time, in an embodiment, the airfoil cross sections are advantageously suitably adjusted and, thus, the (first, respectively second) stagger angles thereof are set.

In an embodiment, the first joint is a swivel and/or sliding joint and/or has at least one rotational degree of freedom, in particular in or about the radial direction, and/or at least one translational or displacement degree of freedom, in particular in the axial direction. Additionally or alternatively, in an embodiment, the second joint is a swivel and/or sliding joint and/or has at least one rotational degree of freedom, in particular in or about the radial direction, and/or at least one translational or displacement degree of freedom, in particular in the axial direction.

In an embodiment, this makes it possible to produce advantageous adjusting kinematics, in particular in an embodiment, to compensate for different lever arm lengths.

In an embodiment, the first joint is axially spaced apart from the second joint, in particular away from or downstream of the first and/or second vane.

In an embodiment, the different stagger angles or adjustments may be hereby advantageously realized.

In an embodiment, a lever arm length of the first coupling element differs from that of the second coupling element, in particular is larger or, preferably smaller than that of the second coupling element, in particular by at least 1%, in particular at least 5%, and/or by no more than 50%, in particular no more than 25% than the lever arm length of the first or second coupling element. Notably, as is customary in the art, a lever arm length is understood here to be a (Cartesian) distance between a connection of the coupling element to the actuating means and a connection of the coupling element to the corresponding vane, in particular to the adjusting, in particular pivot or rotation axis thereof, or another coupling element coupled thereto.

In an embodiment, the different stagger angles or adjustments may be hereby advantageously realized.

In an embodiment, an adjusting, in particular pivot or rotation axis of the first vane and an adjusting, in particular pivot or rotation axis of the second vane are circumferentially in mutual alignment, at least essentially at the same axial position.

In an embodiment, an advantageous flow characteristic and/or adjusting kinematics may be hereby provided.

In an embodiment of the present invention, to adjust a vane cascade described here, the first and second vane are adjusted, in particular jointly, in particular by rotation and/or translation of the actuating means, from the first position into the second position, and thus the at least one airfoil cross section of the first and second vane from the respective first into the respective second stagger angle, in particular swiveled or pivoted, and/or adjusted from the second position into the first position, and thus the at least one airfoil cross section of the first and second vane from the particular second again into the particular first stagger angle, in particular swiveled or pivoted.

In an embodiment, the vane cascade has a plurality of first vanes and/or a plurality of second vanes and/or a plurality of third, in particular further or other vanes; it being possible for two or more first vanes and/or two or more second vanes to be disposed adjacently in groups or circumferentially (in pairs).

In an embodiment, an advantageous flow characteristic and/or adjusting kinematics may be hereby produced, and/or unwanted resonances between adjacent vanes reduced.

BRIEF DESCRIPTION OF THE DRAWINGS

Further advantageous embodiments of the present invention will become apparent from the dependent claims and the following description of preferred embodiments. To this end, the drawing shows, partly in schematic form, in:

DETAILED DESCRIPTION

Figure 1:
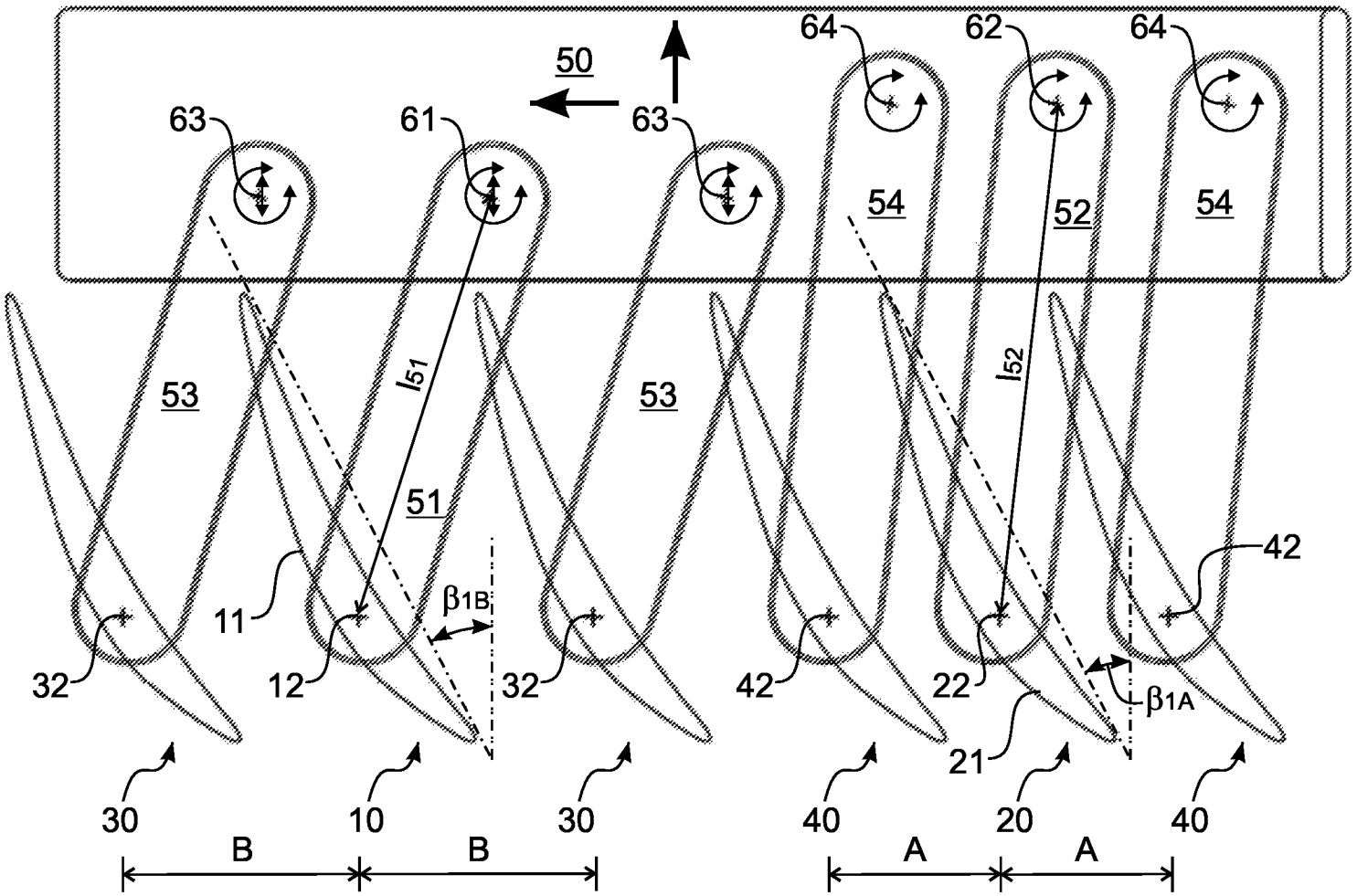
FIG. 1 a portion of a developed view of a vane cascade according to an embodiment of the present invention in a first position.

In a variant of the present invention, FIG. 1 shows a portion of a developed view of a variable vane cascade, in particular guide vane cascade of a turbomachine, in particular of a compressor stage or turbine stage of a gas turbine, in a first position.

The vane cascade features a plurality of vanes, in particular guide vanes, that are circumferentially adjacent (horizontally in FIG. 1), of which only six are shown exemplarily in FIG. 1.

In the circumferential direction, the second vane from the left in FIG. 1, of which an airfoil cross section 11 is shown in the developed view of FIG. 1, features a first distance B from the two further circumferentially adjacent vanes 30 thereof and represents a first vane 10.

The second vane from the right in FIG. 1, of which an airfoil cross section 21 is shown at the same radial height as airfoil cross section 11 in the developed view of FIG. 1, features a second distance A from the two other circumferentially adjacent vanes 40 thereof that is smaller than first distance B (A<B) and represents a second vane 10.

Distance A or B is measured circumferentially between the radial pivot axes or pivot bearings 12, 32, respectively 22, 42 of corresponding vanes 10, 30, respectively 20, 40, about which or in which vanes 10, 20, 30, respectively 40 are rotationally mounted, and which are indicated in FIG. 1 by crosses.

Figure 2:
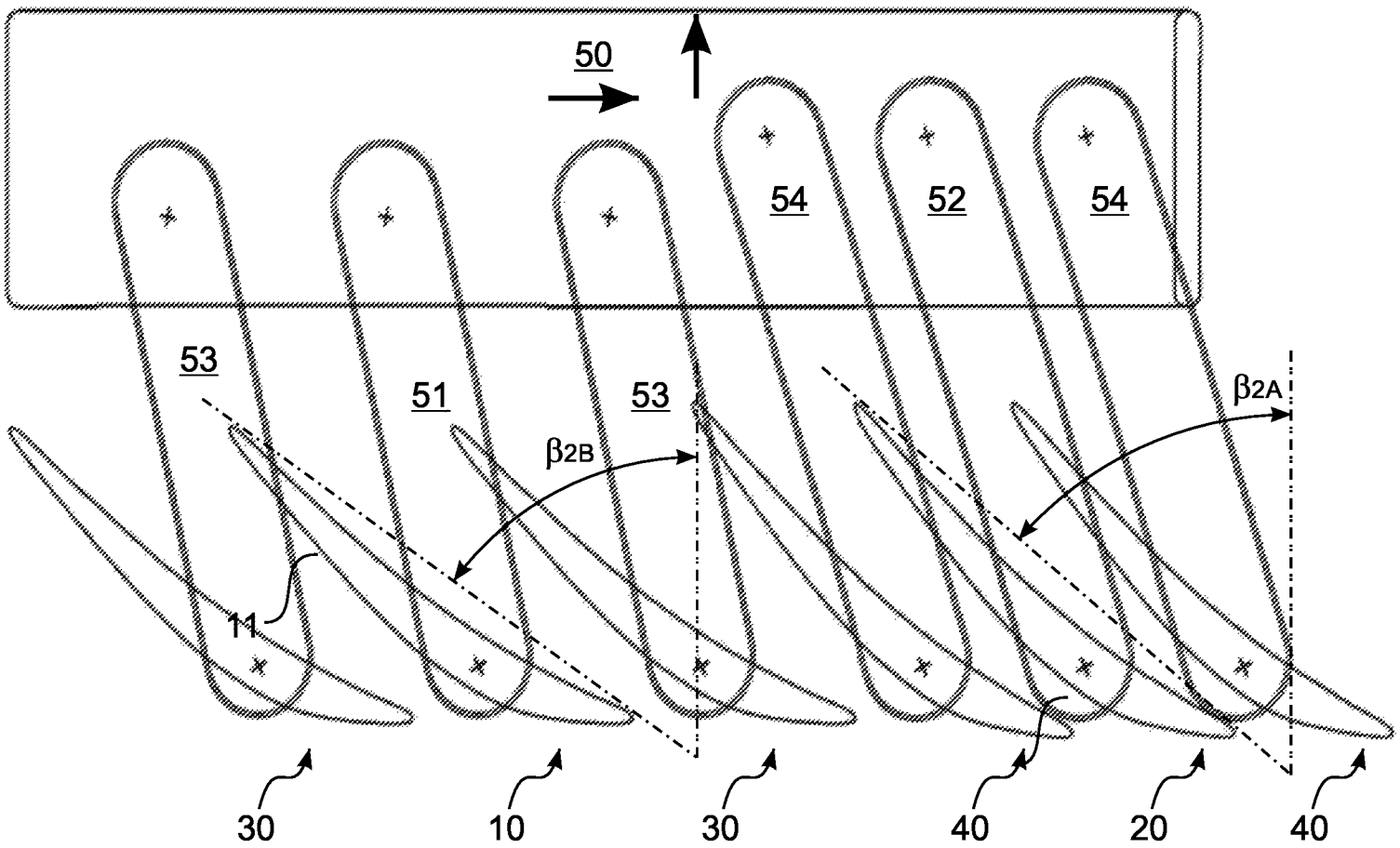
FIG. 2 the vane cascade in a representation that corresponds to FIG. 1, in a second position.

Vanes 10, 20, 30 and 40 may be jointly, reversibly and equidirectionally adjusted by an actuating device from a first position shown in FIG. 1 into a second position shown in FIG. 2 and, accordingly, pivoted about the respective pivot axes 12, 22, 32, respectively, 42 thereof.

In the first position (compare FIG. 1), at least airfoil cross section 11 of first vane 10 features a first stagger angle $\beta_{1B}$ (of first vane 10) between a pressure-side airfoil tangent or airfoil chord thereof indicated by a dot-dash line and the axial direction (extending vertically from the bottom to top in FIG. 1) indicated by a double-dot dash line; at least airfoil cross section 21 of second vane 20 has a same sized and equidirectional first stagger angle $\beta_{1A}$ (of second vane 20).

In the second position (compare FIG. 2), at least airfoil cross section 11 of first vane 10 features a second stagger angle $\beta_{2B}$ (of first vane 10); at least airfoil cross section 21 of second vane 20 has an equidirectional second stagger angle $\beta_{2A}$ (of second vane 20).

A comparison of FIG. 1, 2 reveals, on the one hand, that second stagger angle $\beta_{2B}$ of first vane 10, respectively of airfoil cross section 11 thereof is larger than second stagger angle $\beta_{2A}$ of second vane 20, respectively of airfoil cross section 21 thereof; and, on the other hand, that first stagger angle $\beta_{1B}$ of first vane 10, respectively of airfoil cross section 11 thereof is smaller than second stagger angle $\beta_{2B}$ of first vane 10, respectively of airfoil cross section 11 thereof; and that first stagger angle $\beta_{1A}$ of second vane 20, respectively of airfoil cross section 21 thereof is smaller than second stagger angle $\beta_{2A}$ of second vane 20, respectively of airfoil cross section 21 thereof.

In the case of smaller or more open stagger angles (compare FIG. 1), advantageous outflow angles and, in the case of larger or more closed stagger angles (compare FIG. 2), advantageous free flow cross-sections may be realized between adjacent vanes, and thus advantageous flow conditions produced in each particular case, and a performance and a suction limit improved.

In a generally known manner, the vane cascade has an actuating means having an actuating device in the form of an actuating ring 50 for adjusting vanes 10, 20, 30 and 40 jointly, reversibly and equidirectionally from the first into the second position, that is used to couple first vane 10 by a first coupling element in the form of a (first) actuating lever 51, second vane 20 by a second coupling element in the form of a (second) actuating lever 52, and further or other vanes 30, 40 analogously by one further coupling element each in the form of a (further, respectively other) actuating lever 53, respectively 54.

As the comparison of FIG. 1, 2 reveals and, as indicated in FIG. 1, 2 by corresponding motion arrows, actuating ring 50 may be adjusted rotationally and thus translationally in a positively coupled manner, in particular in the manner known from the German Patent Application DE 103 51 202 A1.

To this end, actuating levers 51-54 are connected to corresponding pivot axes 12, 22, 32 and, respectively, 42 of vanes 10, 20, 30 and, respectively, 40 in corotation therewith and to actuating ring 50 by a joint 61-64; in particular, first actuating lever 51 by a first swivel and sliding joint 61 having one rotational degree of freedom in the radial direction (orthogonally to the image plane of FIG. 1) and one translational degree of freedom in the axial direction (vertically in FIG. 1); and second actuating lever 52 by a second swivel joint 62 having one rotational degree of freedom in the radial direction. In an embodiment, a swivel and sliding joint 61, 63 may be realized by a slide block which slides within an axial slot and to which actuating lever 51 or 53 is rotatably connected.

First joint 61, as well as joints 63 circumferentially aligned therewith are spaced axially away from second joint 62 and joints 64 circumferentially aligned therewith in a direction away from vanes 10, 20, 30, 40. Accordingly, a lever arm length $l_{51}$ of first actuating lever 51 is smaller than a lever arm length $l_{52}$ of second actuating lever 52.

To adjust the vane cascade, the rotation of actuating ring 50, indicated by the motion arrows, about the machine axis (vertical in FIG. 1) and, along with this, axial displacement in a positively coupled manner, adjusts first and second vane 10, 20 jointly from the first position (compare FIG. 1) into the second position (compare FIG. 2) where airfoil cross sections 11, 21 have dissimilar second stagger angles $\beta_{2B}$, $\beta_{2A}$, or, vice versa, from the second position to the first position where airfoil cross sections 11, 21 have same first stagger angles $\beta_{1B}$, $\beta_{1A}$.

Although exemplary embodiments were explained in the preceding description, it should be noted that many modifications are possible. It should also be appreciated that the exemplary embodiments are merely examples and are in no way intended to restrict the scope of protection, the uses or the design. Rather, the foregoing description provides one skilled in the art with a guideline for realizing at least one exemplary embodiment, various modifications being possible, in particular with regard to the function and configuration of the described components, without departing from the scope of protection, as is derived from the claims and the combinations of features equivalent thereto.

LIST OF REFERENCE NUMERALS

10 first vane
11 airfoil cross section of the first vane
12 pivot axis/pivot bearing of the first vane
20 second vane
21 airfoil cross section of the second vane
22 pivot axis/pivot bearing of the second vane
30; 40 further/other vanes
32; 42 pivot axis/pivot bearing of the further/other vanes
50 actuating ring (actuating means)
51 first actuating lever (first coupling element)
52 second actuating lever (second coupling element)
53; 54 actuating lever
61 first swivel and sliding joint
62 swivel joint
63 swivel and sliding joint
64 swivel joint
A second distance
B first distance
$l_{51}$ lever arm length of first actuating lever
$l_{52}$ lever arm length of second actuating lever
$\beta_{1B}$ first stagger angle of first vane
$\beta_{1A}$ first stagger angle of second vane
$\beta_{2B}$ second stagger angle of first vane
$\beta_{2A}$ second stagger angle of second vane

The invention claimed is:

1. A variable vane cascade for a turbomachine, the variable vane cascade comprising:

at least one first vane having at least one first distance from at least one circumferentially adjacent first vane;

at least one second vane having at least one second distance from at least one circumferentially adjacent second vane smaller than the first distance; and an actuator for adjusting the first and second vane from a first position where at least one vane airfoil cross section of the first vane and a vane airfoil cross section of the second vane each have a first stagger angle, into a second position where these airfoil cross sections have second stagger angles, the second stagger angle of the first vane being dissimilar to the second stagger angle of the second vane.

2. The variable vane cascade as recited in claim 1 wherein the first stagger angle of the first vane is equal to the first stagger angle of the second vane.

3. The variable vane cascade as recited in claim 1 wherein the first stagger angle of the first vane is dissimilar to the first stagger angle of the second vane.

4. The variable vane cascade as recited in claim 3 wherein the first stagger angle of the first vane is smaller than the first stagger angle of the second vane.

5. The variable vane cascade as recited in claim 3 wherein the first stagger angle of the first vane is larger than the first stagger angle of the second vane.

6. The variable vane cascade as recited in claim 1 wherein the first stagger angle of the first vane is smaller than the second stagger angle of the first vane; or the first stagger angle of the second vane is smaller than the second stagger angle of the second vane.

7. The variable vane cascade as recited in claim 1 wherein the first stagger angle of the first vane is larger than the second stagger angle of the first vane; or the first stagger angle of the second vane is larger than the second stagger angle of the second vane.

8. The variable vane cascade as recited in claim 1 wherein the actuator has an actuating means including a first and second coupling element, the actuating means for jointly or reversibly adjusting the first and second vane from the first into the second position used to couple the first vane by at least the first coupling element and the second vane by at least the second coupling element.

9. The variable vane cascade as recited in claim 8 wherein the actuating means is rotationally or translationally adjustable, or joined to the first coupling element by a first joint or to the second coupling element by a second joint.

10. The variable vane cascade as recited in claim 9 wherein the first or second joint is a swivel or sliding joint or has at least one rotational or at least one translational degree of freedom.

11. The variable vane cascade as recited in claim 9 wherein the first joint is axially spaced apart from the second joint.

12. The variable vane cascade as recited in claim 8 wherein a lever arm length of the first coupling element differs from a lever arm length of the second coupling element.

13. The variable vane cascade as recited in claim 12 wherein the lever arm length of the first coupling element is smaller than the lever arm length of the second coupling element.

14. The variable vane cascade as recited in claim 12 wherein the lever arm length of the first coupling element is larger than the lever arm length of the second coupling element.

15. The variable vane cascade as recited in claim 12 wherein an adjusting axis of the first vane and an adjusting axis of the second vane are circumferentially mutually aligned.

16. A turbomachine comprising at least one variable vane cascade as recited in claim 1.

17. A gas turbine comprising the turbomachine as recited in claim 16.

18. A compressor or turbine stage of a gas turbine comprising at least one variable vane cascade as recited in claim 1.

19. The variable vane cascade as recited in claim 1 wherein the first and second vanes are guide vanes.

20. The variable vane cascade as recited in claim 1 wherein the actuator adjusts the first and second vanes jointly or reversibly.

21. A method for adjusting the variable vane cascade as recited in claim 1 comprising:

adjusting the first and second vanes from the first position into the second position.

22. The method as recited in claim 21 wherein the first and second vanes are adjusted jointly or reversibly.

23. The variable vane cascade as recited in claim 1 wherein the first and second vanes have radial pivot axes.

24. The variable vane cascade as recited in claim 1 wherein the first stagger angle is between a pressure-side airfoil tangent or airfoil chord of the first vane and an axial direction.

25. The variable vane cascade as recited in claim 24 wherein the first and second vanes have radial pivot axes.

* * * * *